US008381778B2

(12) United States Patent
Van Melick

(10) Patent No.: US 8,381,778 B2
(45) Date of Patent: Feb. 26, 2013

(54) METHOD AND APPARATUS TO CHARGE AEROSOL CONTAINERS WITH FLUID, AND METHOD TO CLEAN A CHARGING APPARATUS

(75) Inventor: Hubertus Maria Roland Van Melick, Schinveld (NL)

(73) Assignee: Friesland Brands B.V. (NL)

( * ) Notice: Subject to any disclaimer, the term of this patent is extended or adjusted under 35 U.S.C. 154(b) by 720 days.

(21) Appl. No.: 12/524,380

(22) PCT Filed: Jan. 25, 2007

(86) PCT No.: PCT/NL2007/050031

§ 371 (c)(1),
(2), (4) Date: Oct. 20, 2009

(87) PCT Pub. No.: WO2008/091143

PCT Pub. Date: Jul. 31, 2008

(65) Prior Publication Data

US 2010/0084044 A1 Apr. 8, 2010

(51) Int. Cl.
*B65B 1/20* (2006.01)

(52) U.S. Cl. ..... 141/72; 366/217; 141/3; 141/20; 141/64; 141/100

(58) Field of Classification Search ..... 141/3, 20, 141/64, 72, 100, 268; 366/217
See application file for complete search history.

(56) References Cited

U.S. PATENT DOCUMENTS

| | | | | |
|---|---|---|---|---|
| 2,203,356 | A * | 6/1940 | Kendall | 366/217 |
| 3,259,152 | A | 7/1966 | Schimkat | |
| 3,654,743 | A | 4/1972 | McGeary | |
| 3,964,526 | A | 6/1976 | Sindermann | |
| 5,558,138 | A | 9/1996 | Stock et al. | |
| 2005/0018535 | A1 * | 1/2005 | Miller | 366/217 |

FOREIGN PATENT DOCUMENTS

| | | |
|---|---|---|
| DE | 3147284 A1 | 6/1983 |
| FR | 2 082 399 | 12/1971 |
| FR | 2 308 549 | 11/1976 |
| WO | WO 2005/054114 A1 | 6/2005 |

* cited by examiner

*Primary Examiner* — Gregory Huson
*Assistant Examiner* — Jason K Niesz
(74) *Attorney, Agent, or Firm* — Jennifer E. Lacroix, Esq.; DLA Piper US LLP

(57) ABSTRACT

Method for charging an aerosol container with fluid, comprising:—providing an aerosol container (1) having a reservoir (2) comprising a product, for example a foodproduct, and having product discharge means (1*a*);—gradually supplying fluid to the reservoir of the container (1) via the discharge means (1*a*) thereof; and—applying a mixing movement to the container (1), preferably during the supplying of the fluid, to mix the fluid and product at least partly with each other, wherein the mixing movement is such that at least a first virtual point (P1, P2) of a virtual center line (Z) of the container reservoir (2) follows an endless path around a respective virtual axis. Embodiments of the invention also provide a cleaning method and a dummy container.

20 Claims, 12 Drawing Sheets

Figure 1:
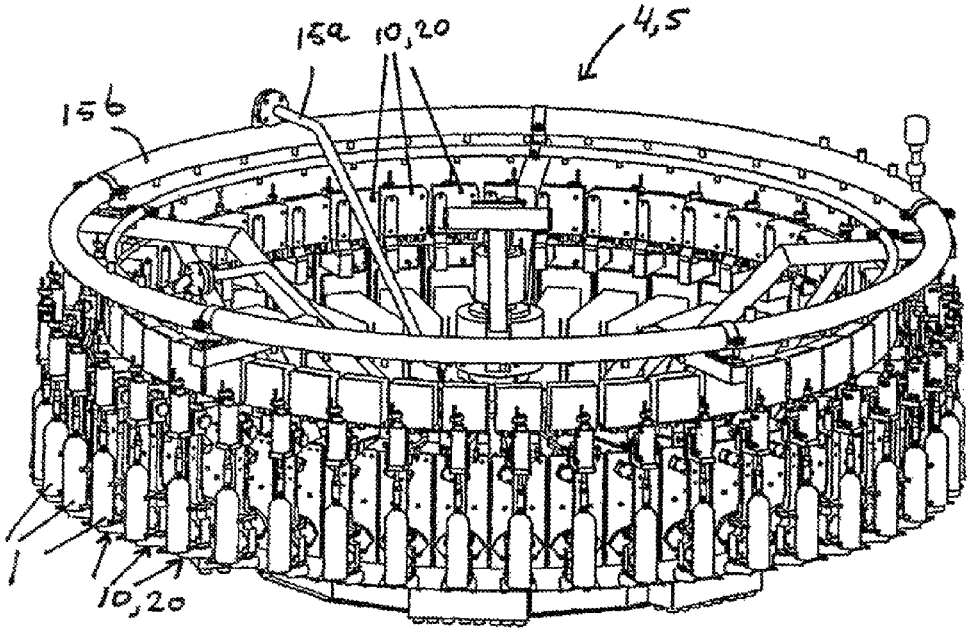

METHOD AND APPARATUS TO CHARGE AEROSOL CONTAINERS WITH FLUID, AND METHOD TO CLEAN A CHARGING APPARATUS

The invention relates to a method for charging an aerosol container with fluid, comprising:

providing an aerosol container having a reservoir comprising a product, for example a foodproduct, and having product discharge means;

gradually supplying the fluid to the reservoir of the container via the discharge means thereof; and applying a mixing movement to the container, preferably during the supplying of the fluid, to mix the fluid and product at least partly with each other.

Also, the invention relates to an apparatus to carry out such a method.

From the prior art, various methods are known to charge aerosol containers, wherein the containers are being shaken during the charging, to mix propellant at least partly with a product that is already present in the container. For example, U.S. Pat. No. 3,259,152 discloses a machine for simultaneously injecting pressurised propellant gas into and shaking cans. In the method known from this publication, the cans are oriented vertically and reciprocally moved vertically, in longitudinal can directions. The shaking aims to provide a desired mixing and charging of the cans. However, this known shaking method involves a relatively time-consuming and energy-inefficient mixing process, involves a rather uncontrolled agitation of the product, and might have a negative impact on desired characteristics of the product. Moreover, the vertical orientation of the container as such provides a relatively small mixing surface, which leads to an inefficient mixing of gas into the product when shaking the container in vertical directions. Besides, the respective shaking mechanism is relatively complex, not very durable due to high loads experienced by the mechanism during operation, and therefore requires relatively much maintenance.

In an alternative known method, the containers are oriented horizontally, and are shaken in horizontal directions during the gradual gas injection. Thus, a mixing surface is increased compared to the above-mentioned method of shaking a vertically orientated container in vertical directions, however, the horizontal orientation of the container and horizontal shaking thereof still leads to an inefficient mixing of gas into the product. Also, this method and respective apparatus also suffers from a relatively low durability, particularly since relatively large accelerations have to be applied to achieve desired shaking movements, leading to relatively high maintenance cost and long down-times. Besides, horizontal positioning of the containers can increase risk of contamination, particularly since there might be a small change that a small amount of product can escape from a container during decoupling of gas injection means after a gas injection/shaking sequence.

Another method, known from the art, is the so-called impact gas injection. In that case, one shot of high pressure gas is injected abruptly into the container (without shaking the container), such that the injection as such leads to the mixing of gas with product already present in the container. However, impact-injection might damage or otherwise negatively affect the product, and does not always provide a desired mixing efficiency.

The present invention aims to provide an improved method and apparatus, which do not have above-mentioned disadvantages. Particularly, the invention aims to provide a method and apparatus, wherein aerosol containers, comprising product, can be charged with fluid in an efficient manner.

According to an embodiment of the invention, this object is achieved by a method, which is characterised in that the mixing movement is such that at least a first virtual point of a virtual centre line of the container reservoir follows an endless path around a respective virtual axis.

For example, in a particular embodiment, the mixing movement can involve an iterative movement of the container, wherein a mentioned virtual point of the virtual centre line of the container reservoir can move along a circular path or an ellipse path around the respective virtual axis.

It has been found that this mixing movement can lead to an efficient mixing of fluid (for example a propellant gas and/or a propellant fluid) with product in the container, particularly since the movement can provide a relatively large product surface area available for the mixing. Particularly, depending for example on the type of fluid and product and a desired mixing recipe (for example relating to container speed and amount of fluid to be charged to the container), the mixing can be achieved in a relatively short mixing period and/or using relatively little energy. Also, this mixing movement can be carried out in a reliable and durable manner by an apparatus, specifically adapted to carry out the method. Particularly, it has been found that the application of a mixing movement of the present invention can lead to an improved mixing, wherein desired properties of the product, contained in the container reservoir, can be upheld. For example, it has been found that the present manner of container movement is particularly advantageous to charge gas in a container comprising cream, however, the invention can also be applied in case of different products contained in the container, for example different foodproducts, or cosmetic products, oil based products, gels, a coating substance or paint, insecticides, as will be appreciated by the skilled person.

In a preferred embodiment, the mixing movement is applied to cause at least part of the product, contained in the container, to follow an endless loop along inner sides of the container reservoir. Thus, a relatively large, continuously varying, product surface area can be available during the charging of the fluid, to mix fluid at least partly, and relatively gently, with the product. Herein, for example, the product can continuously circulate through the container reservoir, preferably from a reservoir bottom via a first side wall part to a reservoir top, and back to the bottom via a second side wall part opposite the first side wall part.

Besides, there is provided an apparatus arranged to charge aerosol containers, the apparatus comprising:

at least one container holder to hold an aerosol container; and fluid supply means to gradually supply a fluid to a container held by the container holder, via product discharge means of the container.

Such an apparatus is known from U.S. Pat. No. 3,259,152, as has been described above. The known apparatus is relatively inefficient, experiences relatively high operational loads and requires relatively much maintenance.

According to an embodiment of the present invention, an improved apparatus is characterised in that the apparatus is configured to apply a mixing movement to the container held by the holder during use, preferably during the supplying of the fluid, the mixing movement involving at least a first virtual point of a virtual centre line of the container reservoir following an endless path around a respective virtual axis.

Thus, above-mentioned advantaged can be provided.

According to another embodiment, there is provided a method to clean an aerosol container charging apparatus, the charging apparatus comprising:

at least one container holder to hold an aerosol container; and fluid supply means to supply a fluid to a container held by the container holder, via product discharge means of the container.

As an example, but not necessarily, the apparatus can be the above-described apparatus. Various cleaning methods are known from the prior art, such as a manual cleansing and disinfecting of downstream parts of the fluid supply means. Known methods are relatively time-consuming, particularly in case a proper disinfecting is required to prevent contamination of the aerosol containers, to be charged, during operation of the apparatus.

The present invention aims to alleviate this problem, and particularly aims to provide a relatively simple and reliable means to clean the apparatus swiftly.

According to an embodiment, the cleaning method is characterised in that it includes:

providing at least one dummy container, each dummy container comprising a fluid injection port that can cooperate with the fluid supply means of the aerosol charging apparatus when the dummy container is held by the container holder of the apparatus;

holding the dummy container by the container holder; and supplying a cleaning fluid to the dummy container, held by the container holder, via the respective fluid injection port and utilising the fluid supply means.

Thus, during cleaning, instead of an aerosol container, to be charged with fluid, there is provided a dummy container, which can receive a suitable cleaning fluid from the fluid supply means. Thus, the fluid supply means can be cleaned efficiently, swiftly and reliably. Preferably, the cleaning fluid is steam, for example pressurized steam having a temperature above 100° C., for example about 140° C. In that case, the steam is preferably condensed by the dummy container during the cleansing, resulting in water that can simply, and safely, be drained from the dummy container to an environment.

In a further advantageous embodiment there is provided a dummy container specifically adapted to be used as dummy container in the cleaning method according to the invention. Preferably, the dummy container is provided with a cleaning fluid collection chamber that can also be configured to discharge collected cleaning fluid towards an environment. Besides, advantageously, the dummy container can comprise a steam trap (nl: condenspot), configured to automatically condense steam received via the fluid injection port, so that steam can be used as a cleaning fluid in a safe manner. Steam is a relatively cheap cleaning fluid, and can provide a thorough and swift disinfecting of respective parts of the apparatus.

Figure 2:
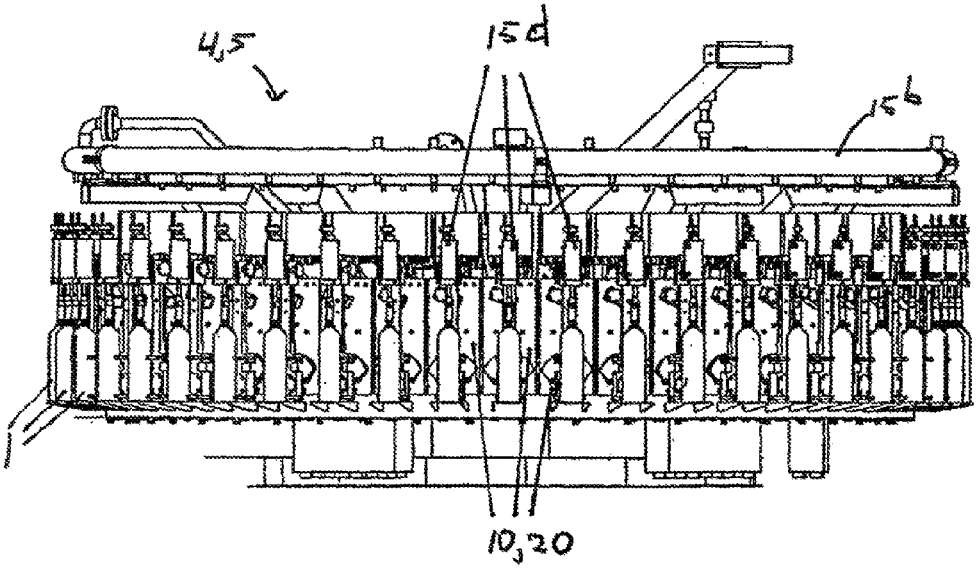
Figure 3:
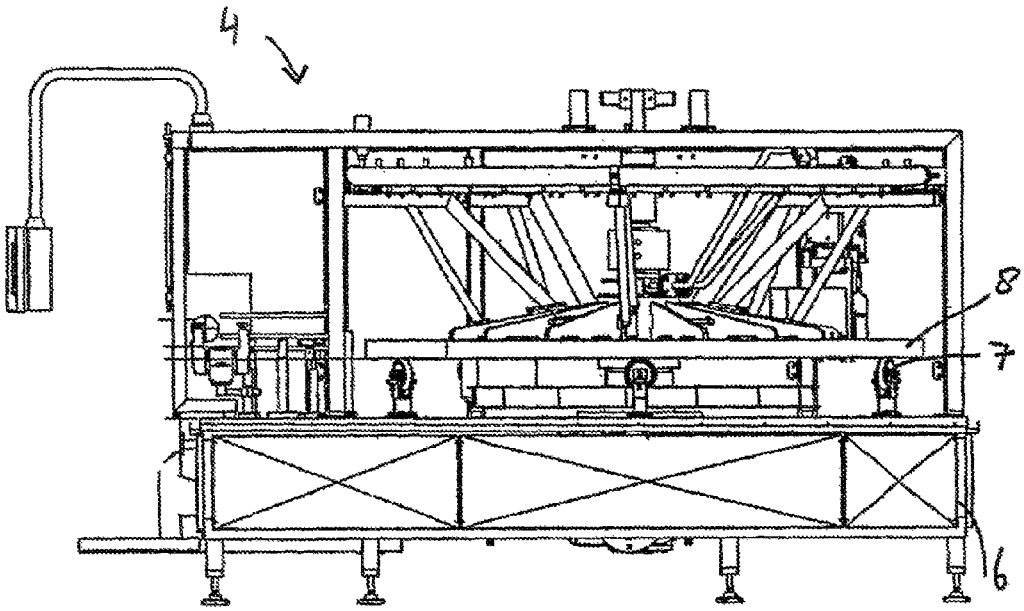
Figure 4:
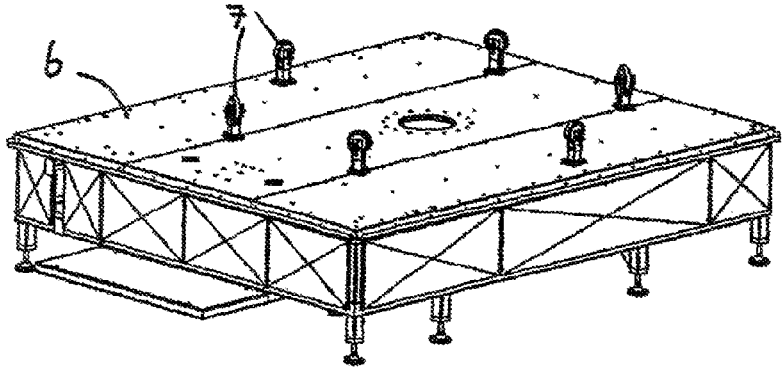
Figure 5:
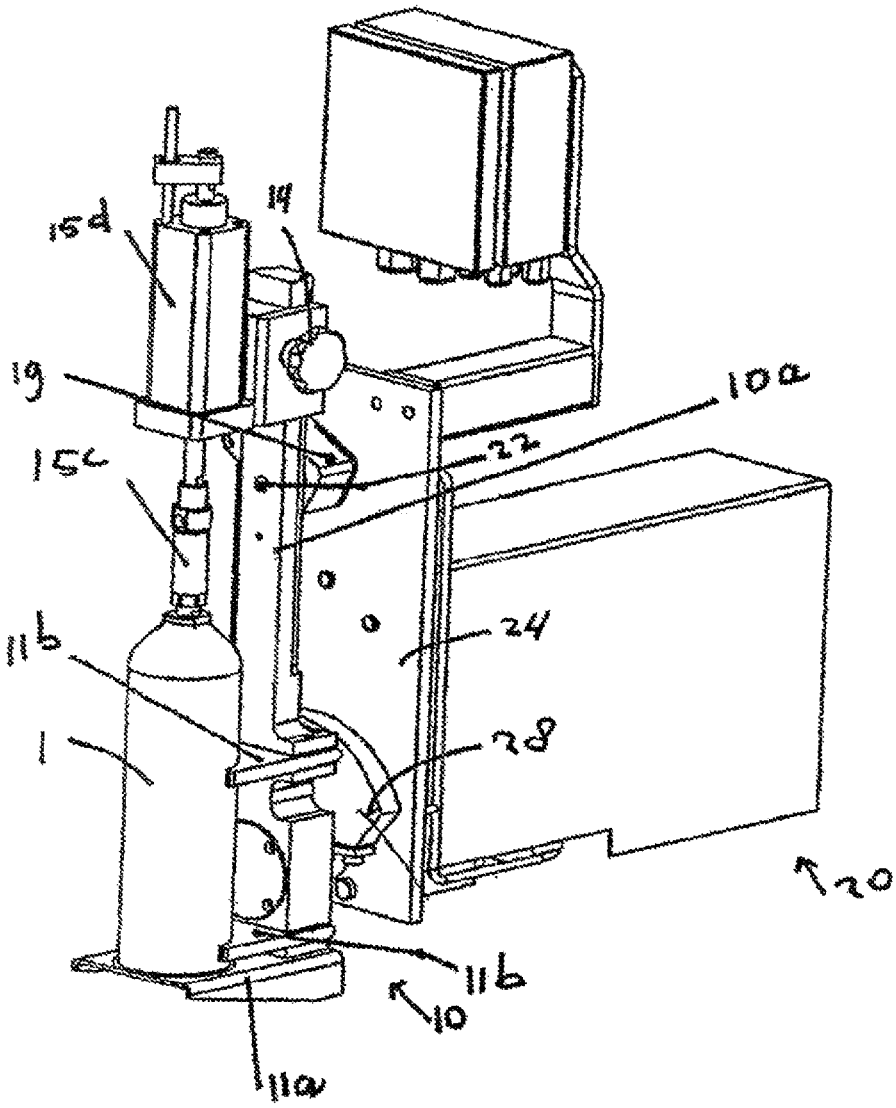
Figure 6:
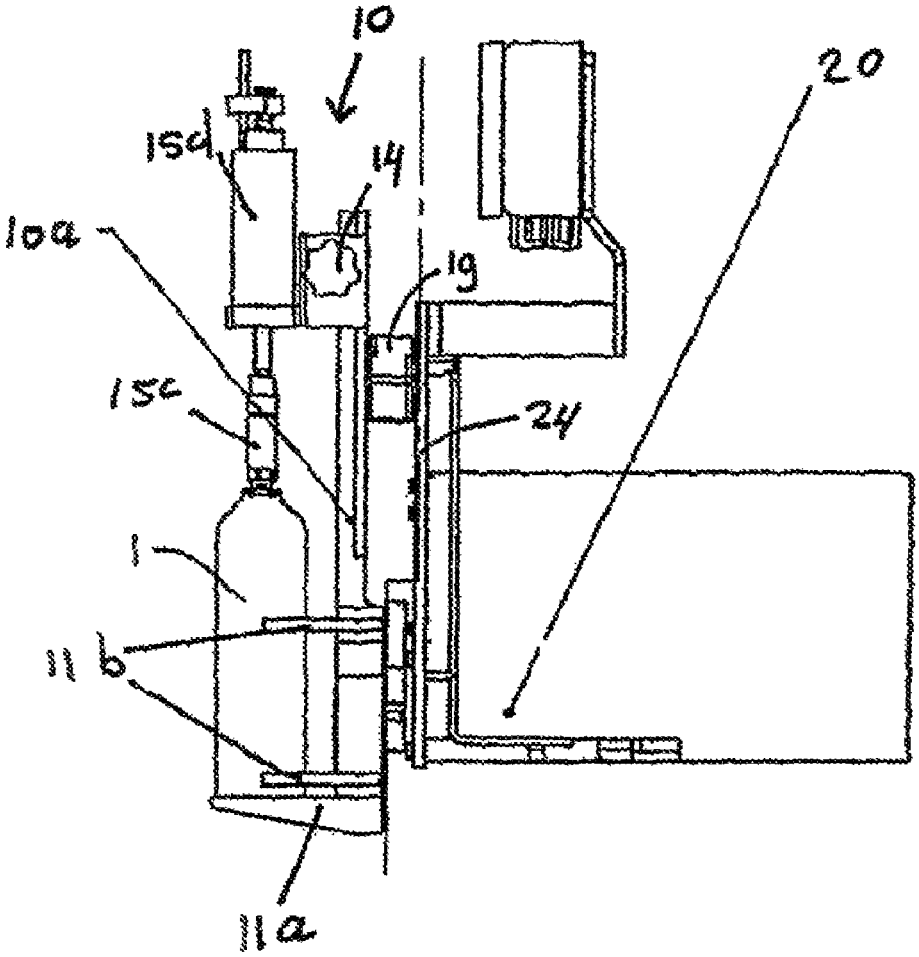
Figure 7:
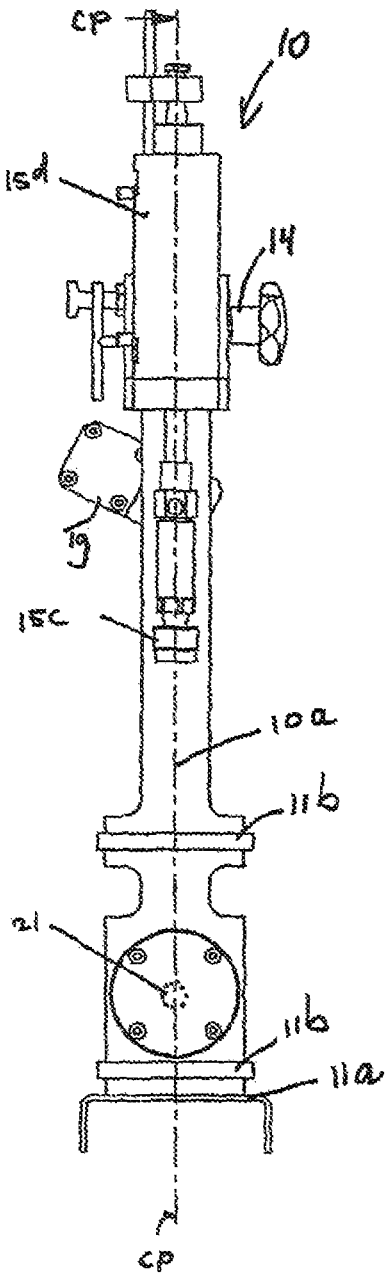
Figure 8:
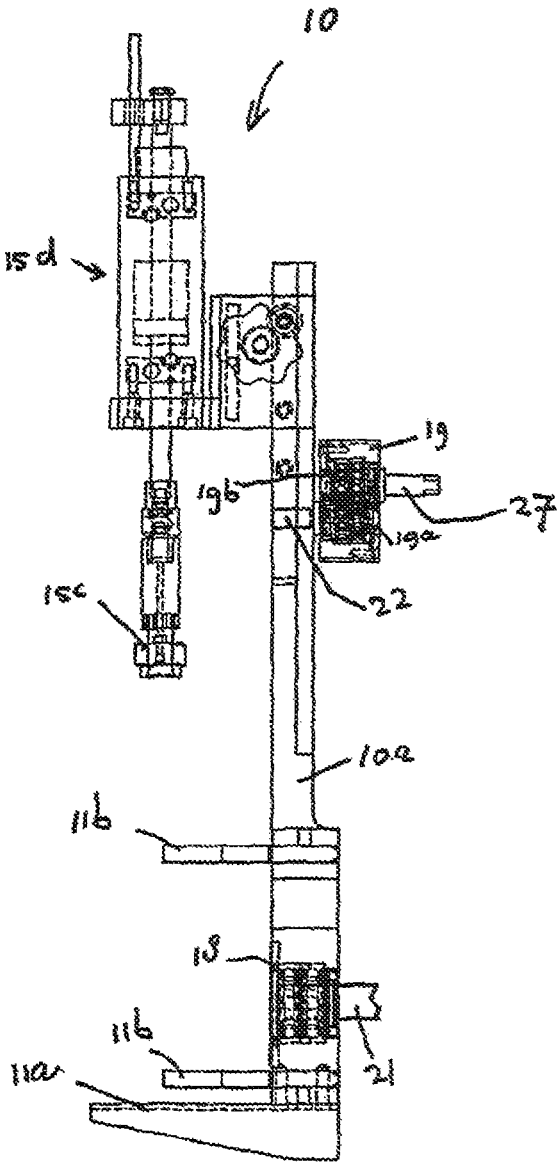

Further advantageous embodiments of the invention are described in the dependent claims. These and other aspects of the invention will be apparent from and elucidated with reference to the embodiments described hereafter. Therein shows:

FIG. 1 a perspective view of a main part of an embodiment of the present invention;

FIG. 2 a front view of the embodiment of FIG. 1;

FIG. 3 a front view of part of the embodiment of FIG. 1, showing a carousel support frame;

FIG. 4 a perspective view of the support frame of the embodiment of FIG. 1;

FIG. 5 a perspective view of an assembly of a container holder and respective drive mechanism of the embodiment of FIG. 1;

FIG. 6 a side view of the assembly shown in FIG. 5;

FIG. 7 a front view of a container holder, comprising a downstream part of gas supply means, of the assembly of FIG. 5;

FIG. 8 a opened side view of FIG. 7

Figure 9:
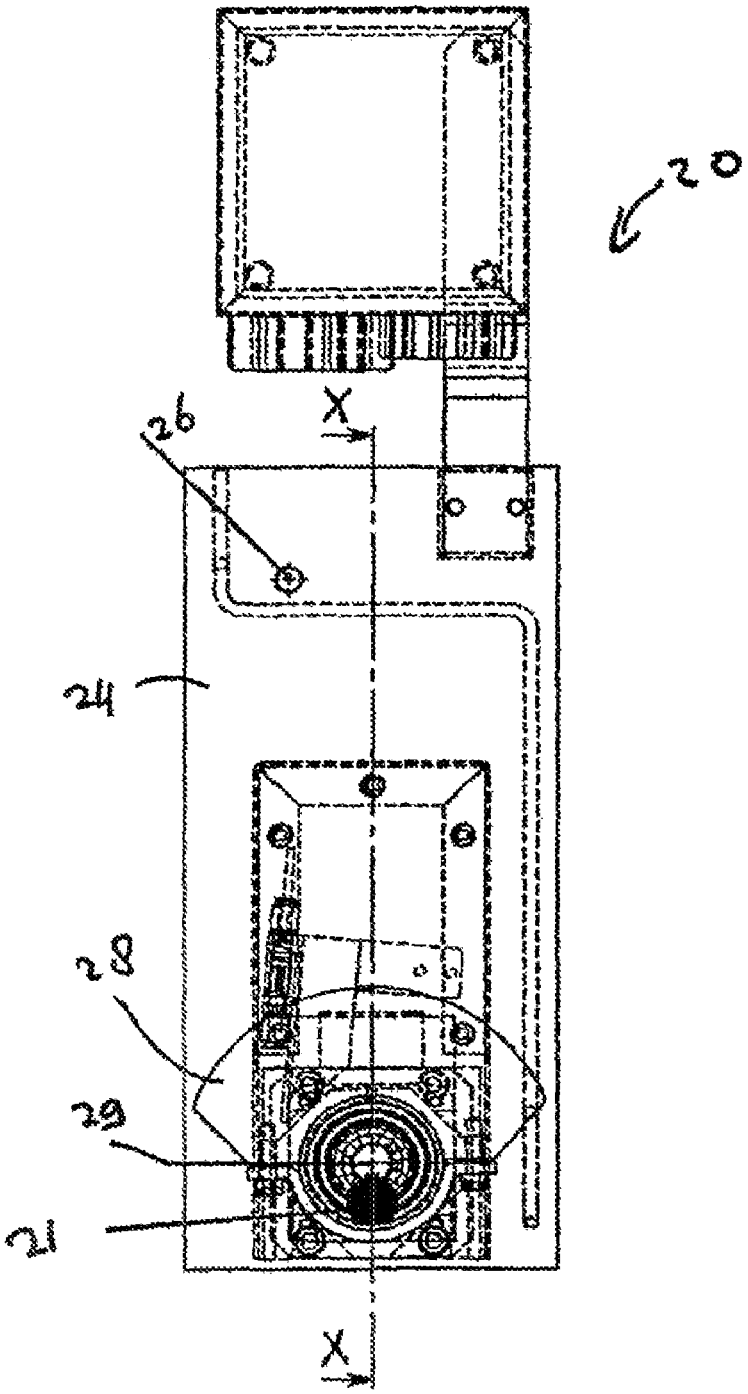
Figure 10:
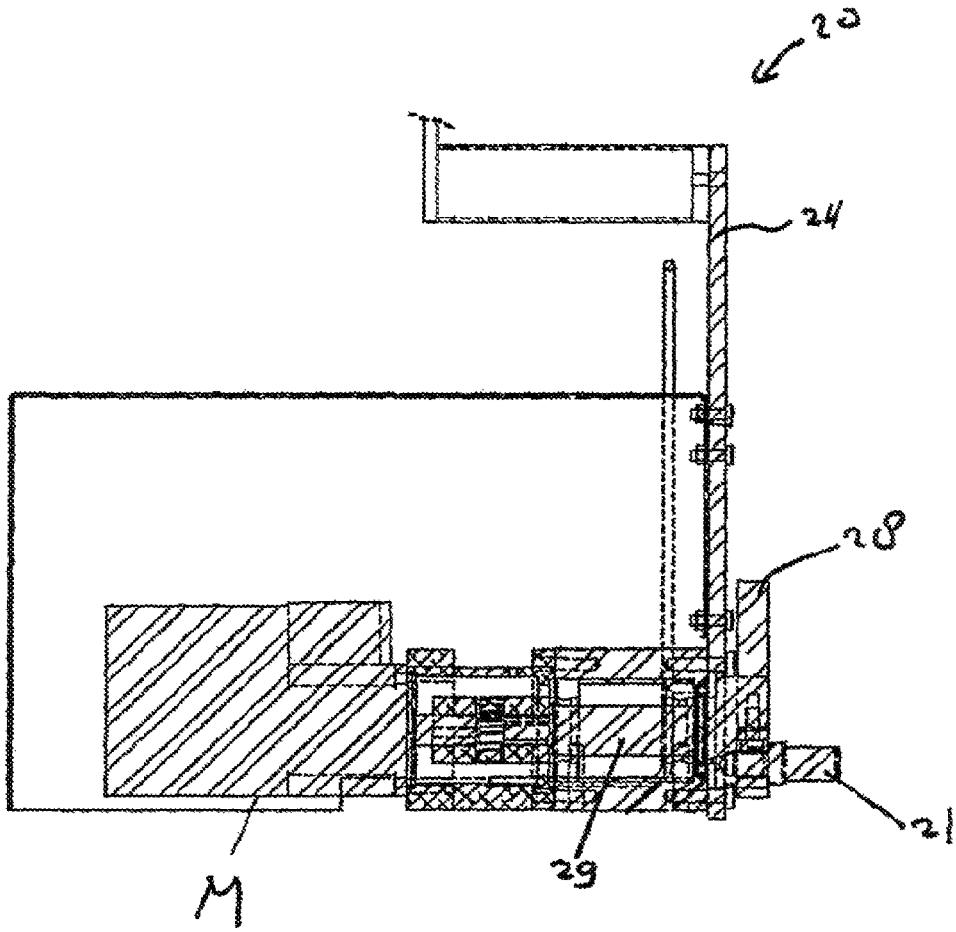
Figure 12:
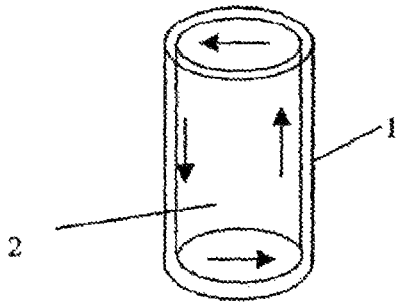
Figure 13A:
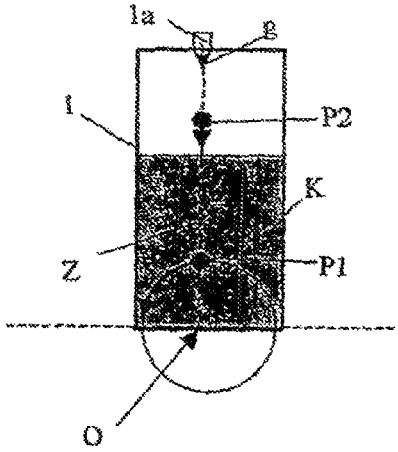
Figure 13B:
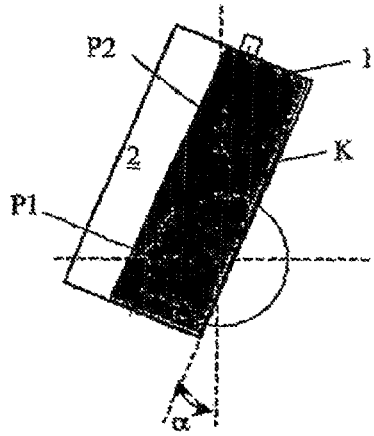
Figure 13C:
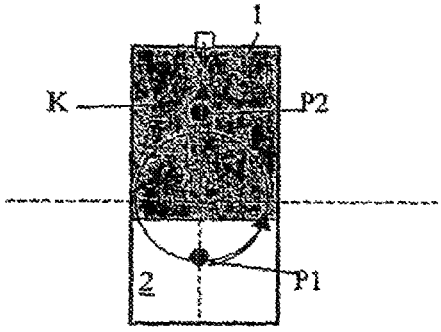
Figure 13D:
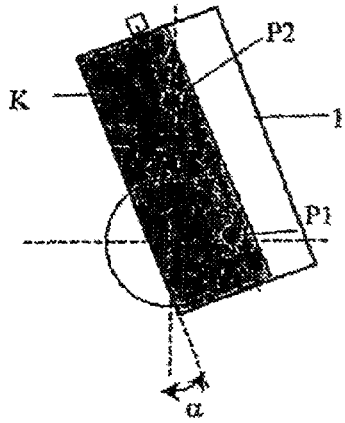
Figure 14A:
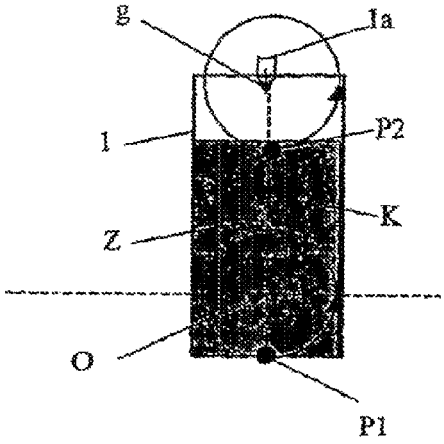
Figure 14B:
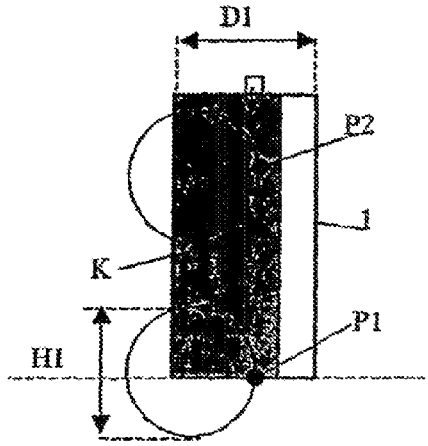
Figure 16:
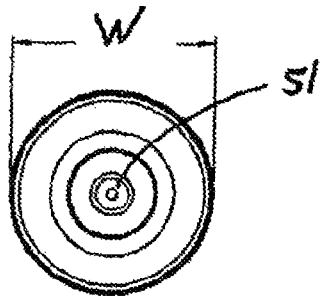
Figure 15:
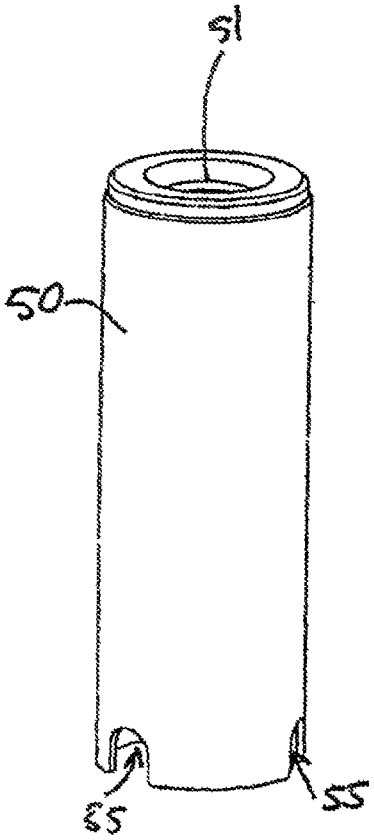
Figure 17:
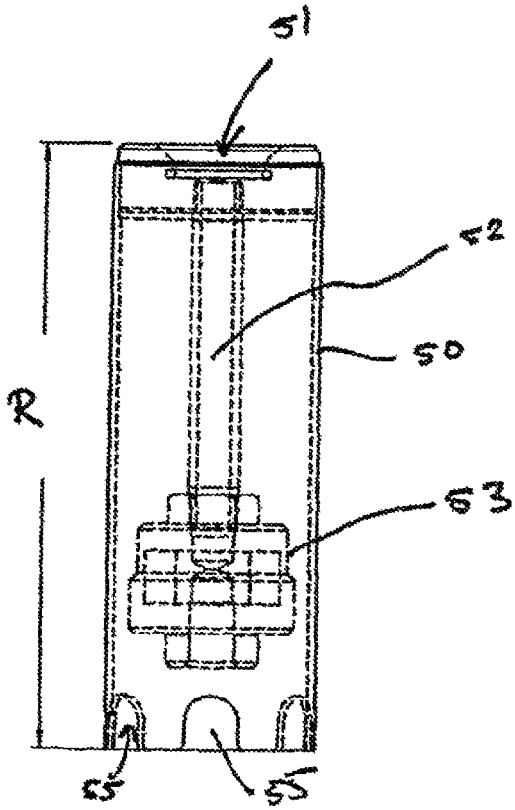
Figure 18:
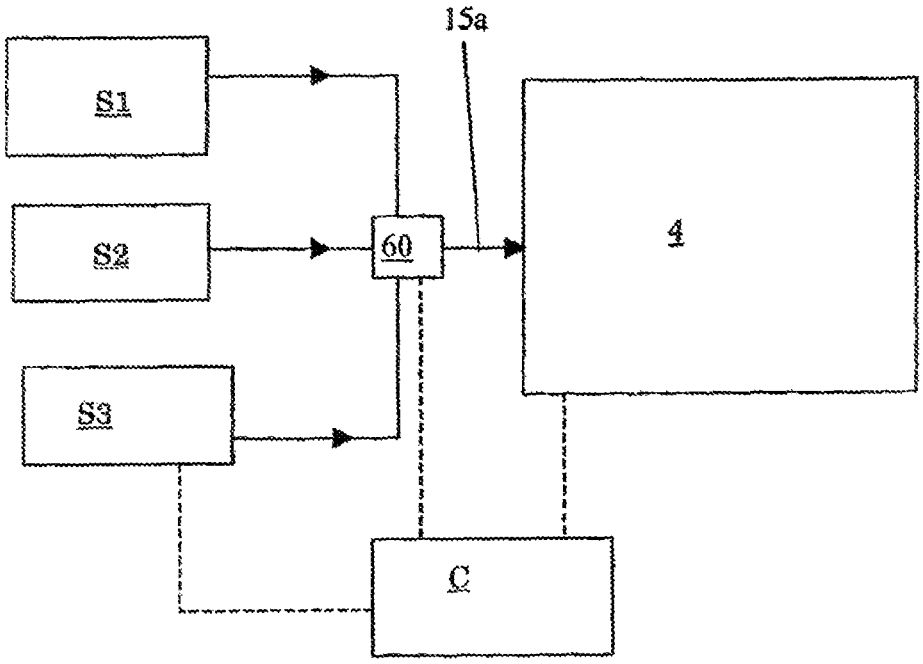

FIG. 9 an opened front view of a drive mechanism of the FIG. 5 assembly;

FIG. 10 a cross-section over line X-X of FIG. 9;

FIGS. 11A-11D schematically a first embodiment of container mixing-movements;

FIG. 12 schematically a result of a container mixing movement;

FIGS. 13A-13D schematically a second embodiment of container mixing-movements;

FIGS. 14A-14B schematically a third embodiment of container mixing-movements;

FIG. 15 a perspective view of an embodiment of a dummy container;

FIG. 16 a top view of the embodiment of FIG. 15;

FIG. 17 a side view of the embodiment of FIG. 15, wherein the steam trap is depicted by dashed lines; and FIG. 18 schematically a further embodiment of a container charging system.

In the present application, similar or corresponding features are denoted by similar or corresponding reference signs.

FIGS. 1-10 shown an embodiment of an aerosol container charging apparatus 4. A further embodiment of the apparatus is also schematically depicted in FIG. 18.

The apparatus 4 preferably comprises a rotatable carousel 5 having a plurality of container charging modules 10, 20. A drive (not depicted) is provided to rotate the carousel 4 around a vertical centre axis thereof, for example at rates of about one to several times a minute.

Each of the mentioned container charging modules 10, 20 comprises an assembly of a container holder 10 and a respective drive mechanism 20 to move the container holders 10, as well as a fluid injector 15*c* (see FIGS. 5-10, showing these assemblies in more detail). The container holders 10 are located at the outer contour of the carousel 5. In the present embodiment, each container holder 10 is provided with its own dedicated, preferably autonomously operating, drive mechanism 20. The system can also be configured differently as will be appreciated by the skilled person. For example, a plurality of container charging modules can be provided with or connected to a single drive mechanism configured to move respective container holders 10 in a predetermined or desired manner.

Containers 1, to be charged by the apparatus, as such are known from the prior art. For example, the aerosol containers 1 to be charged can be of a non-rechargeable type, of a substantially cylindrical shape, to be discarded after being used up. The containers 1, to be charged, can already be packed with various dischargeable products K, for example a liquid product. Herein, the reservoirs of the containers 1 will generally not be 100% filled with the product, leaving ample space (the 'head space') to charge a desired amount of fluid into the reservoirs. For example, each container reservoir 2 comprise up to ⅔ (volume %) of product, when the container is being fed to the charging apparatus 4. Each container 1 is also provided with operable discharge means 1*a*, provided at the container top and usually comprising suitable valve means and a discharge nozzle 1*a* (schematically shown in FIGS. 11, 13, 14), to discharge the product from the reservoir 2. After having been charged with fluid, each container 1 can also be provided with further dispensing means, for example a manually operable dispensing head, such that the discharge nozzle 1*a* can discharge product via these further dispensing means/head.

The product K contained in the containers 1 can be foodproduct, the foodproduct being safe for consumption, or other products to be dispensed. As a non-limiting example, the foodproduct can comprise cream, or a desert, mousse, or other dispensable foodproducts.

Referring to FIG. 1-2, 5-6, the charging apparatus comprises fluid supply means 15, to supply a fluid to the container charging modules 10, 20 to gradually charge containers 1 held thereby, via the discharge nozzle 1*a* of the container 1. In one embodiment, the fluid can be in a gas phase when it is charged by the injector 15*c* into the container 1, as will be explained below. Alternatively, at least part of the fluid can be in a liquid phase during the charging thereof. Also, the fluid may at least partly switch its phase during the charging, for example due to an gradually increasing charging pressure and depending on the type of fluid (see below).

The fluid supply means can be configured in various ways, and can comprise fluid supply tubes, valve means, flow regulators, pressure sensors and other means, as will be appreciated by the skilled person. For example, the fluid supply means can comprise a fluid supply line 15*a* which is coupled to a ring shaped fluid distribution pipe 15*b* of the carousel, the distribution pipe being coupled to the fluid injectors 15*c* of the container charging modules 10, 20, for example by flexible tubing (not shown) or in a different manner.

Preferably, (see FIG. 18) various fluid sources S1, S2, S3 can be coupled to the fluid supply line 15*a*, for example one or more fluid sources S1, S2 to feed one or more fluids to the fluid injectors 15*c* of the carousel, via the distribution pipe 15*b*. More preferably, also, a cleaning fluid source S3 is available and can be coupled to the fluid supply means 15, as will be explained below. Alternatively, the apparatus 4 can be provided with only a single fluid source, to feed fluid to the fluid supply means 15.

As a non limiting example, the fluid supply means 15 of the charging apparatus 4 can be configured to supply fluid to the aerosol containers, such that the initial pressure in the containers 1 (after the charging) is for example in the range of 2-18 atmospheres, depending on the amount of packed product, as will be appreciated by the skilled person. For example, in case the product is a foodproduct, for example cream, the initial pressure can be in the range of 5-18 atmospheres. Various types of fluid can be used. For example, the fluid can include one or more gasses, and can be a gas mixture. Particularly, the fluid is substantially gaseous or in a gas phase at 1 atmosphere and room temperature (20° C.). The fluid can also be substantially gaseous or in a gas phase at a higher initial container pressure (so that the fluid in the container will always be substantially gaseous or in the gas phase) at room temperature (20° C.). Alternatively, the fluid at least partly be in a condensed or liquid phase at the higher initial container pressure (so that the fluid in the container will at least partly be in a condensed or liquid phase after charging the container) at room temperature (20° C.).

Particularly, the fluid is a propellant gas, for discharging/propelling product from the container. In case the product is a foodproduct, preferably, the gas consist of one or more gasses acceptable from the viewpoint of food technology, for example a gas which substantially dissolves in the foodproduct, a gas which substantially does not dissolve in the foodproduct and a combination of these gasses. Particularly, the gas can comprise CO2, nitrogen (N2), laughing gas (N2O) or a combination of these gasses (such as nitrogen and laughing gas). In that case, the propellant gas will also be gaseous (or in the gas phase) after being charged into the container. For example, good results have been obtained in the case that at least 15 w % (weight %) of the propellant is a gas that substantially does not dissolve in the foodproduct, such as N2, and the remainder of the propellant is a gas that substantially dissolves in the foodproduct, such as N2O. Alternatively, the propellant is not formed of: the combination of at least 15 w % N2 and a further N2O, for example in the case that the propellant only consists of CO2, N2 or N2.

In case the product is not a foodproduct, the propellant fluid can also include, for example, one or more of: propane, butane and isobutane, or other fluids. In the latter case, for example, a lower limit of the pressure range of the initial pressure in the container 1 can be about 3 to 5 bar (with an upper limit of, for example, 18 atmospheres as mentioned above). Moreover, in that case, the propellant may be in a gas phase at room temperature and 1 atmosphere, and the propellant may at least partly in a liquid phase after being charged into the container 1 (i.e., in the case that the propellant has acquired the initial container pressure, and at room temperature).

Besides, there can be provided one or more suitable controllers C (see FIG. 18) to control the apparatus 4, for example a controller C comprising one or more processors, computers, memories, timers, micro-electronics, suitable hardware and/or software, communication means, and/or other suitable control unit means, as will be clear to the skilled person.

Preferably, each container charging module 10, 20 is provided with its own dedicated, preferably autonomously operating, local charging controller, having for example one or more processors, computers, memories, timers, micro-electronics, suitable hardware and/or software, and/or other suitable control unit means. The local controller can be part of the respective drive mechanism. For example, the local controller can be configured to autonomously, automatically start a predetermined charging recipe in that case that the respective holder 10 has been provided with and holds an aerosol container 1. For example, such a charging recipe can include the amount of fluid (for example a propellant gas and/or liquid) to be fed into the container 1, a desired fluid charging pressure or time-dependent charging pressure profile (such as a pressure that gradually rises over time), a desired charging time period, and a desired container mixing movement (see below), for example including container acceleration, speed and/or number of iterations of the container movement. For example, a main controller C and local charging module controllers can be configured to communicate with each other, for example to set desired charging parameters, to upload charging recipes into the local controllers, and/or to check or test the functioning of the charging modules.

In a further embodiment, the apparatus is provided with a carousel support frame 6 to stably support the carousel, see FIGS. 3-4. In the present embodiment, the support frame 6 is provided with a number or wheels 7, arranged along a virtual circle and being spaced-apart, that carry a ring shaped lower support member 8 of the carousel (the support member 8 being concentric with the centre axis of the carousel). The wheels 7 can prevent or reduce carousel resonance and carousel vibrations during use of the apparatus. Preferably, to this aim, the carousel supporting wheels 7 are made of plastic.

In a further embodiment, there can be provided a loading station (not shown) to feed containers 1 to the carousel 5 and to place containers 1 one after another onto the container holders, passing the loading station due to rotation of the carousel 5. Similarly, there can be provided an unloading station (not shown) to receive/unload containers 1 from container holders, passing the unloading station due to rotation of the carousel 5. Herein, the carousel 5 can transport the containers, held by the container holder 10, from a said loading station to a said unloading station. For example, during operation, each container holder 10 can be brought into a container loading/unloading position by the respective drive mechanism 20, in which loading/unloading position the holder 10 can receive a container at the loading station, and can deliver a container at the unloading station, for example in a substantially vertical container orientation (as in FIG. 1-2, 5-6).

Also, the apparatus 4 is configured to apply mixing movements to the aerosol containers 1 held thereby, preferably during the feeding of fluid to the containers 1. It has been found that, advantageously, mixing movements are to be applied such that one or more virtual points P1, P2 of a virtual centre line Z of the container reservoir 2 move around one or more respective virtual axes, preferably along circular or ellipse paths. Herein, the mentioned centre line Z is the virtual longitudinal centre axis of the container 1, which extends from a centre of the container bottom to a centre of discharge means 1*a*. For example, the apparatus is configured to iteratively move each container holder 10 in a manner to cause at least part of a product that is contained in a container 1, being held by that holder during use, to follow an endless loop along inner sides of the container reservoir 2. Examples of such movements are depicted in FIGS. 11-14 and will be explained below.

Charging Module Embodiment

As follows from FIGS. 5-10, in the present embodiment, each charging module comprises a container holder 10, comprising a movable frame member 10*a*. The movable frame member 10*a* comprises a container support 11*a* to carry a container (by supporting the container bottom), and positioning members 11*b* to support a container side wall to position the container 1 centrally on the support 11*a* (when viewed in front view). For example, each container support 11*a* extends perpendicularly with respect to the movable frame member 10*a*, from a lower end thereof, and in a substantially horizontal direction in the case that the container holder 10 is in the loading/unloading position (see FIG. 5-6). In the present embodiment, each positioning member 11*b* comprises a support plate extending parallel to the container support 11*a* and having a substantial semi-circular aperture to receive and position the container.

Opposite the container support 11*a*, a downstream part of the mentioned fluid supply means, comprising a fluid injector 15*c*, is provided. The module comprises a fluid injector actuator 15*d*, which is mounted onto the movable frame member 10*a*, to move the fluid injector 15*c* towards the container support 11*a* to a fluid injection position (as in FIG. 5-6), in which the fluid injector 15*c* can stably position and hold the container 1 onto the opposite support 11*a*, and in which the fluid injector 15*c* can cooperate with discharge nozzle 1*a* of the container held by the holder 10, to gradually charge the container reservoir 2 with fluid via its discharge nozzle 1*a*. Injector actuator 15*d* can also move the fluid injector 15*c* away from the container support 11*a*, to release the container 1. Besides, adjustment means 14 are provided, to adjust an initial distance between injector 15*c* and support 11*a*, so that containers 1 of different heights can be accommodated there between.

Preferably, each charging module is configured to detect whether or not a container 1 has been positioned on the container support 11*a*. As an example, the module can comprise one or more sensors to detect a container 1, for example an optical sensor, and/or one or more pressure sensors integrated in the support 11*a* and/or the positioning members 11*b*.

The drive mechanisms 20 of the carousel modules 10, 20 can be configured to iteratively move each container holder 10, such that at least a first virtual point of a virtual centre line Z of the container reservoir 2 of a container 1 held by that holder 10 moves around a respective virtual axis of rotation. Examples for such container movements are depicted in FIG. 11-13.

As follows from FIGS. 5-10, in the present embodiment, each drive mechanism 20 comprises a driven shaft 29 which is coupled eccentrically to a lower part of the container holder frame member 10*a*, via a first axis 21 that extends in parallel direction with respect to the driven shaft 29. The drive mechanism comprises a drive device M, for example a suitable electromotor, more preferably a stepping motor, to rotate the driven shaft 29 in order to move the first axis 21 along a circular path (a virtual centre of this path, which is defined by the driven shaft 29, is denoted by O in FIGS. 11, 13, 14). The drive device M can comprise its own dedicated, preferably autonomously operating, controller, which may be part of or be integrated with an above-mentioned local container charging controller of a container charging module. Also, there can be provided to a counterbalance mass 28, connected to the driven shaft 29 and configured to provide counterbalance with respect to the mass of the container holder and a container held thereby during operation. As an example, the counterbalance mass may be adjustable, to provide counterbalancing with respect to containers having different initial masses. In the present embodiment, each charging module 10, 20 is provided with its own drive device M. In an alternative embodiment, a plurality of the charging modules 10, 20 can be provided with or coupled or connectable to a common drive device, particularly to rotate the driven shafts of those modules at desired time periods. In the latter case, for example, the driven shafts of the modules may be driven at the same time by the common drive device. Alternatively, the driven shafts may be coupled to a common drive device in such a way, for example via a suitable controllable drive transmission, that they can still be driven independently from each other by the common drive device.

In the present embodiment, a lower part of each container holder frame member 10*a* is provided with a suitable first bearing 18 (for example a radial ball bearing, see FIG. 8) to rotationally couple the first axis 21 to the container holder 10, such that the first axis 21 extends in substantially parallel direction with respect to a container support surface of the container bottom support member 11*a*. In the present embodiment, the first axis 21 is coupled near the container support member 11*a*.

A second part of the container holder 10 can be provided with a second axis 22 extending in parallel with respect to the first axis 21. The first axis 21 and second axis 22 are spaced-apart from each other. In the present embodiment, the distance between the first and second axis 21, 22 is the same as or larger than the maximum height of containers 1 to be charged. Also, for example, the second axis 22 can be guided along one o: a curved path, a substantially straight path, a substantially circular path, and a substantially ellipse path. Besides, in the present embodiment, both the first and second axis 21, 22 extend in a longitudinal centre plane CP (see FIG. 7) of the container holder 10, the centre plane CP preferably coinciding with the longitudinal centre line Z of a container reservoir 2 of a container 1 held by the container holder 10 during operation.

In an alternative embodiment, for example, the first axis of the holder 10 can be guided along one of: a curved path, a substantially straight path, a substantially circular path, and a substantially ellipse path, wherein the second axis can follow a substantially circular or ellipse path during operation.

In the present embodiment, the second axis 22 is guided along a curved path, around a pivot shaft 27, by a pivot member or pivot arm 19 (see FIG. 8). As an example, the second axis 22 can be integrally connected to the container holder frame member 10*a*, and the pivot shaft 27 can be coupled to a housing of the drive mechanism 20. In FIG. 9, a pivot shaft receiving aperture 26 is depicted, being provided in a front plate 24 of the drive mechanism 20, the aperture 26 receiving the pivot shaft 27 after assembly. As an example, the pivot member 19 can comprise a second bearing 19*a* to rotationally hold the mentioned second axis 22, and a third bearing 19*b* to rotationally hold the pivot shaft 27. The skilled person will appreciate that the second axis 22 can also be coupled or held in a different manner to, for example, a housing or front plate of the drive mechanism 20. Particularly, in the present embodiment, the length of the pivot member 19 is such that the first axis 21 can follow a mentioned circular path during operation of the drive device M, resulting in an iteratively pivoting of the pivot member 19 with respect to the pivot shaft 27 (and thus resulting in the second axis 22 moving iteratively up and down along an arc).

As a result, the container holder 10 can interactively move from a lower (container loading/unloading) vertical position to a first intermediate position wherein the holder 10 is tilted in a first direction, to an upper vertical position and back to the lower position via a second intermediate position, wherein the holder 10 is tilted in a second direction which is opposite to the first tilting direction. For example, maximum tilting angles of a container holder frame centre line CP with respect to a vertical plane can be smaller than about 45° during operation.

The fluid charging module 10, 20 is preferably configured such that a resulting container mixing movement can cause at least part of a product K, contained in the container 1, to follow an endless loop along inner sides of the container reservoir 2, as is schematically depicted in FIGS. 11, 13, 14, and in FIG. 12 by arrows. The container movement shown in FIGS. 11A-11D resembles a movement provided by the present embodiment most closely (however, in FIG. 11A-11D, a second virtual point P2 of the container follows an ellipse whereas the present apparatus embodiment will also apply a small curved path to that point P2, due to the pivoting motion of the second axis 22). For example, to this aim, the diameter of the circular path followed by the first axis 21 can be at least about the same as the height L1 of an interior space of a container reservoir (the 'head space') which initially does not comprise product (see FIG. 11A). Naturally, this depends, amongst others, on the position of the first axis 21 relative to a container 1 held by the container holder 10.

Figure 11A:
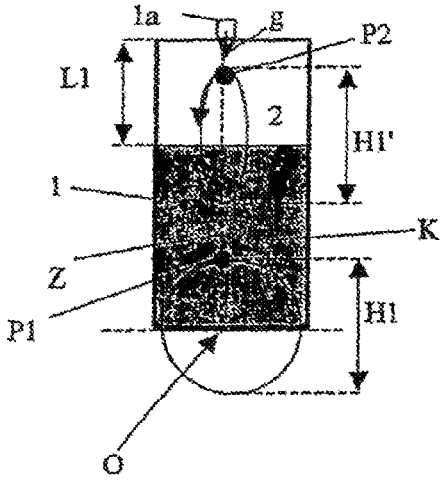
Figure 11B:
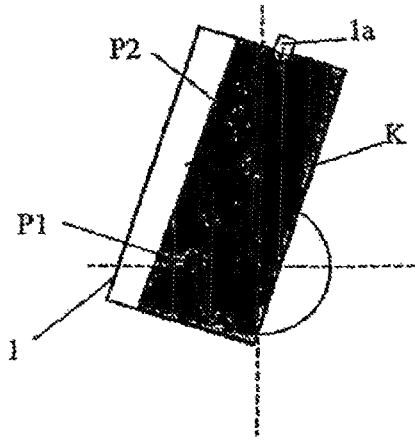
Figure 11C:
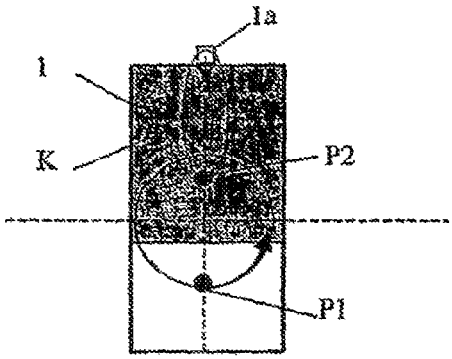
Figure 11D:
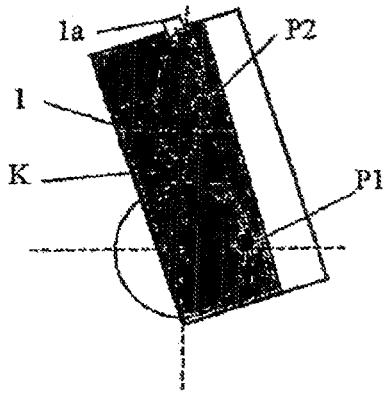

Also, preferably, the charging module 10, 20 is configured to apply a mixing movement, such that a minimum height difference H1 of the path followed by a bottom or top of the container 1 (held by the holder 10) can be at least about the same as the height L1 of the interior space of a container reservoir which initially does not comprise product (see FIG. 11A). Besides, as follows from the drawings, a maximum height difference of the path followed by a bottom or top of the container 1 can be significantly smaller than the overall height of the container (the height being the distance between container top and bottom), for example smaller than half the height of the container (see for example FIG. 14A, in which case a height difference H1 of the paths followed by the bottom and top of the container 1 are about the same as or smaller than a diameter D1 of the container).

Operation

During use of the apparatus shown in the drawings, the carousel 5 is rotated around its centre axis, and containers 1 are fed to the container holders 10 of the modules 10, 20, at a suitable loading station. Each of these containers 1 is partly filled with product K. To receive a container, a container holder 10 is held by its drive mechanism 20 in its loading/unloading position. In the following, preferably, the container filling module 10, 20 autonomously handles/controls a respective container charging and mixing process.

Each time a charging module 10, 20 detects receiving a container 1 on the respective support 11*a*, for example utilizing a mentioned sensor, preferably, the fluid injector 15*c* is automatically brought downwardly to a fluid injection position (as in FIG. 5-6), towards the container 1, to maintain the container 1 onto the opposite support 11*a*. Then, the container holder 10 is brought into a mixing movement and fluid is gradually fed by the fluid injector 15*c* into the reservoir 2 of the container 1, via the product discharge nozzle 1*a* of the container. During charging, the temperature of the fluid can be about room temperature, or it can be a different temperature, depending on the type of fluid and on the product in the containers 1.

Gradual charging of the containers 1 can be achieved in various ways, for example via a controlling of fluid flow such that a substantially constant continuous fluid flow (l/min) is injected in to each container 1 until a desired amount of fluid has been fed into the container 1, of via a controlling of fluid pressure during the charging such that the fluid pressure (for example the pressure in the injector 15*c*, downstream of the injector 15*c* and/or upstream from the injector 15*c*) gradually rises from about 1 atmosphere to a desired initial container pressure, or using a feedback charging control, or a combination of such methods anchor different gradual charging methods. Herein, some types of fluids to be injected, such as CO2, nitrogen and laughing gas, can remain in their gas phases when they are injected into the containers 1 and thereafter. Other types of fluids, such as propane, butane and isobutane, may also be at least partly in a liquid phase during their supply to the containers 1 anchor after being charged into the containers 1.

The charging can follow a certain recipe, for example including a charging time of a plurality of seconds, for example 10 to 20 seconds or more, a desired charging pressure or pressure profile over charging time, a desired internal container reservoir pressure to be obtained, a desired fluid or fluid mixture to be fed to the container reservoir 2, a desired mixing movement speed and mixing movement direction, and/or other parameters.

In the present embodiment, the mixing movement is preferably applied during the supplying of the fluid, to mix the propellant (particularly propellant gas) and (food) product at least partly with each other. Also, for example, the mixing movement can be applied during desired time periods before and/or after the feeding of fluid to the container 1.

In the present embodiment, a resulting container mixing movement involves a certain iterative movement of the container 1, in which at least a first virtual point P1 of the virtual centre line Z of the container reservoir 2 moves around a respective virtual axis, preferably along a circular path (as in the present embodiments) or an ellipse path. Particularly, the mixing movement is applied to cause at least part of the product K, contained in the container 1, to follow an endless loop along inner sides of the container reservoir 2.

In the embodiment of FIGS. 1-10, the mixing movement is achieved by operation of the drive device M, which can drive the driven shaft 29, leading to rotation of the eccentrically positioned first axis 21 and a respective lower part of the container holder 10. This movement induces a pivoting movement of an upper part of the container holder 10, with respect of the pivot shaft 27, as will be appreciated by the skilled person. The container 1, held by the holder 10, and downstream fluid injection means of the module 10, 20 follow the movement of the container holder 10.

FIGS. 11A-11D show four subsequent positions of a resulting movement of the container 1, similar to movement that will be achieved by operation of the apparatus of FIGS. 1-10. In the figures, product positions in the container due to the movement are schematically indicated (the product K is shown schematically in grey), particularly after a certain number of mixing movement iterations have evolved and a certain stable continuous movement state of the product K with respect to the container wall has been established. Charging of fluid via container nozzle 1*a* is schematically indicated by an arrow g.

As follows from FIGS. 11A-11D, the present container mixing movement involves moving the container 1 iteratively from a first vertical position (see FIG. 11A) to a first intermediate position wherein the container is tilted in a first direction (see FIG. 11B), to an opposite second vertical position (FIG. 11C), and back to the first vertical position via a second intermediate position (FIG. 11D), in which second intermediate position the container 1 is tilted in a second direction which is opposite to the first tilting direction. For example, maximum tilting angles $\alpha$ (see FIG. 11B, 11D) of the container centre line Z with respect to a vertical plane can be smaller than about 45°.

In FIG. 11, the container mixing movement leads to various virtual points of the container centre line Z moving along endless paths around respective, different, virtual axes (or points of the centre line Z). A first virtual point P1 and second point P2 and their curved paths have been indicated in the drawing. For example, a first point P1 located near the container bottom follows a circular path, and a second point P2 located near a container top follows an ellipse. Referring to FIGS. 1-10, in the present mixing movement embodiment, the first virtual container reservoir point P1 can coincide with the mentioned first axis 21 of the holder 10, and the second point P2 is located between the first axis 21 and second axis 22.

Also, a diameter H1 of the circular path of the first point P1 and a height H1' of the ellipse path of the other point P2 can be at least the same as the height L1 of the initially empty container head space, but can be substantially smaller than the overall container height. Preferably, the heights H1, H1' of the paths of the virtual points P1, P2 of centre line Z are about the same as or slightly larger than the height L1 of the initially empty container head space.

For example, paths of various virtual centre line points P1, P2 can have different lengths (as in FIG. 11), and particularly different horizontal widths but substantially equal heights (H1, H1'). In the present embodiment, each mentioned virtual axis, around which a respective centre line point P1, P2 follows an endless path, extends in a substantially horizontal direction. Thus, in the present embodiment, the curved paths of virtual points P1, P2 generally extend in a vertical plane, wherein the container is being held in a generally upright (vertical) manner (or more particularly: the container 1 reaches or maintains a substantially vertical container position during at least part of the mixing movement thereof), with the container bottom being faced generally downwardly and the container top upwardly. In an alternative embodiment, for example, the container 1 can be inclined, the virtual centre line points P1, P2 of the container following paths in an virtual inclined plane.

Due to the present mixing movement, the container 1 substantially moves around the product K, or, the product K rotates along the inner container wall (see FIG. 12) if viewed from the container reservoir as a reference. Herein, the product can continuously circulate through the container reservoir 2, from a reservoir bottom via a first side wall part to a reservoir top, and back to the bottom via a second side wall part opposite the first side wall part. Thus, a relatively large varying product surface area can be provided to mix with fluid, charge via the nozzle 1*a*, so that a very efficient mixing can be achieved. Besides, the present mixing movement can be achieved using relatively little energy and relatively low loads on the drive mechanism 20, in a durable manner. Also, the wear on the container holder 10 and respective drive mechanism 20 is relatively low during use, particularly with respect of prior art container charging/shaking machines.

FIGS. 13A-13D show an other embodiment of an advantageous container mixing movement. The embodiment shown in FIG. 13A-13D differs from the embodiment of FIG. 11, in that a second virtual point P2 of the container centre axis only moves iteratively in vertical directions, parallel to the container centre line Z. For example, to this aim, a container holder 10 can be coupled with a suitable guide axis which is slidably guided in vertical direction with respect to, for example, the housing or a front plate of the drive mechanism 20.

FIGS. 14A, 14B shown another embodiment of a mixing movement, which differs from the FIG. 11 embodiment, in that all virtual container centre points P1, P2 move along respective circular paths, having equal diameters but different centres. Thus, the container 1 is held vertically throughout each mixing movement cycle.

In a further embodiment, during operation, the movements of the container holders 10 of the various charging modules 10, 20 are not substantially correlated with each other. For example, this can be achieved simply by the application of autonomously operating modules 10, 20.

After fluid has been charged into a container 1 by an above-described method, the container 1 can be automatically removed from the carousel 4, at a suitable unloading station of the apparatus. To this aim, the container holder 10 can be returned to its original loading/unloading position and the respective the fluid injector 15*c* can be automatically removed from the container 1, held by that holder 10.

The present method and apparatus can efficiently charge large numbers of aerosol containers 1. The apparatus requires significantly less maintenance than conventional aerosol charging/shaking machines (particularly, it is expected that the present apparatus requires only 10% of the maintenance which was required by conventional machines). Besides, the present apparatus can produce relatively little noise compared to conventional machines.

In another embodiment, it is desired to clean and sterilize an aerosol charging apparatus in an efficient manner. To that aim, there is provided a portable dummy container 50, an example of which is shown in FIGS. 15-17. In the following, the usage of the dummy container 50 will be discussed referring to the apparatus of FIGS. 1-10. However, the dummy container 50 can also be used in combination with other charging machines, for example with a conventional aerosol charging apparatus.

The external dimensions of the dummy container 50 can be the same as or similar to an aerosol container 1 that is to be charged by the charging apparatus 4 to be cleansed. For example, the dummy container 50 can have a substantially cylindrical shape, can have a diameter W in the range of about 1-10 cm, and can have a height R in the range of about 10-30 cm. Also, depending on the charging machine, the dummy container 5 can have other dimensions. Besides, a cylindrical wall of the dummy container 50 can be made of steel, aluminum, or other suitable materials.

In the present embodiment, the dummy container 50 comprises a substantially open bottom, and a closed cylindrical side wall see FIG. 15). A top part of the dummy container 50 preferably comprises a fluid injection port 51 that can cooperate with the fluid supply means 15*c* of the aerosol charging apparatus 4, to be treated, when the dummy container 50 is held by a container holder 10 of the apparatus, such that fluid supply means 15*c* of the aerosol charging apparatus 4 can supply a desired cleaning fluid to the dummy container 50.

Also, the dummy container 50 comprises an internal cleaning fluid collection chamber 52 that can preferably communicate with an environment to discharge collected cleaning fluid to the environment. For example to this aim, the container 50 can include one or more discharge openings 55, for example in a bottom edge of the container 50.

Preferably, the dummy container 50 is designed to be used with steam as cleaning fluid. In that case, advantageously, the dummy container 50 is provided with a steam trap 53, configured to automatically condense the steam received via the fluid injection port 51. In the present embodiment, the steam trap 53 is located above a bottom edge of the container. Resulting water, released by the steam trap 53, can then be safely discharged, through the open container bottom and via outlets 55 of the container, to the environment.

The steam trap 53 can be configured in various ways, as will be appreciated by the skilled person. For example, the steam trap 53 can comprise a so-called fixed orifice trap, having a steam restrictor device with a fixed orifice configuration, an inverted bucket type trap, a thermodynamic or disk type steam trap or another steam trap type.

FIG. 18 shows an embodiment of an aerosol container charging apparatus 4 (which might be, for example, similar to the embodiment of FIG. 1-10) comprising a main fluid supply line 15*a* which can be coupled to one or more first fluid sources S1, S2, and to a cleaning fluid source S3. In the present embodiment, the cleaning fluid source S3 can be a steam generator. A controller C of the apparatus 4 is configured to operate a flow controller 60, to connect a desired gas/fluid source S1-S3 to the main supply 15*a*. Also, the apparatus controller C can be configured to control the cleaning fluid source S3, for example to activate and deactivate that source S3.

During an aerosol charging process, the controller C controls the flow controller 60 to connect one or more of the first fluid sources S1, S2 to the main supply line 15*a*, to supply fluid/fluids (for example gas/gasses, depending on the temperature and pressure thereof, as will be appreciated by the skilled person) to the downstream gas injectors 15*c*.

At the start of a subsequent apparatus cleaning period, one or more container charging stations of the charging apparatus 4 can be provided with a respective dummy container 50. The fluid supply means 15 of the apparatus can be connected to the steam generator S3, to supply steam to at least one of the fluid injectors, cooperating with a dummy container 50.

Herein, the main controller C can control the flow controller 60 to disconnect the fluid sources S1, S2 from the main supply line 15*a*. Also, the main controller can request that dummy containers 50 are provided to the charging apparatus. Besides, in case of an apparatus having autonomously operating charging modules 10, 20, the main controller C can signal those modules that a cleaning cycle is to be commenced. As a result, the autonomously operating charging modules 10, 20 can be brought into a cleansing mode, wherein no specific shaking or mixing movements are applied to the dummy containers 50 received by the modules 10, 20, and wherein only cleaning fluid is to be charged to the dummy containers 50.

Then, dummy containers 50 are loaded onto the aerosol container holders 10, for example automatically via an aerosol container loading station using a suitable container supply conveyor (not shown), and preferably automatically coupled to the fluid injectors 15*c* of the charging apparatus. The loading and coupling can be similar to the loading and coupling of the aerosol containers during normal aerosol container charging operation.

Steam is generated by the steam generator S3, and is fed via the supply lines 15*a*, 15*b* and fluid injectors 15*c* to the collection chambers of the dummy containers 50 held by the container holders 10. For example, the steam can have a temperature of about 120° C. or higher (for example about 140° C.), preferably having a relatively high pressure, for example about 2 bar or higher.

Then, each dummy container 50 can collect the steam, received via the injection port 51 from the charging module 10, 20, and can depressurise and/or at least partly cool the steam, via the steam trap 53. At least part of the condensed steam (i.e. water) is released via a respective exhaust part 55 of the dummy container C, wherein the release of water is preferably gravity induced.

After a desired cleansing period (for example ranging from 10-30 minutes, or a different time period), the dummy containers 50 can be unloaded from the apparatus 4, for example at a suitable aerosol unloading station which is also used by the apparatus to unload aerosol containers during an aerosol container charging process.

In this way, the fluid supply means 15 of the container charging apparatus 4 can be cleaned and disinfected in a relatively simple manner. It has been found that the present cleaning method can be completed in about 30 minutes, which is much faster than a conventional manual cleaning procedure of a conventional charging apparatus (which usually takes about 4 hours). Besides, the present cleansing method can achieve a thorough cleaning of the fluid supply means of the charging apparatus.

Although the illustrative embodiments of the present invention have been described in greater detail with reference to the accompanying drawings, it will be understood that the invention is not limited to those embodiments. Various changes or modifications may be effected by one skilled in the art without departing from the scope or the spirit of the invention as defined in the claims.

For example, in an embodiment, a single driving mechanism can be provided with or coupled to a plurality of container holders, the driving mechanism being configured to apply the above-described mixing movement to the container holders. Besides, each container holder can be configured to hold one or more containers, wherein fluid supply means are provided to gradually supply fluid to the one or more containers held by the container holder.

It is to be understood that in the present application, the term "comprising" does not exclude other elements or steps. Also, each of the terms "a" and "an" does not exclude a plurality. Any reference sign(s) in the claims shall not be construed as limiting the scope of the claims.

The invention claimed is:

1. Method for charging an aerosol container with fluid, comprising:

providing an aerosol container having a reservoir comprising a product, for example a foodproduct, and having product discharge means;

gradually supplying a fluid to the reservoir of the container via the discharge means thereof; and applying a mixing movement to the container, to mix the fluid and product at least partly with each other, characterised in that the mixing movement is such that at least a first virtual point of a virtual centre line of the container reservoir follows an endless path around a respective virtual axis.

2. The method according to claim 1, wherein the mixing movement is applied to cause at least part of the product, contained in the container, to follow an endless loop along inner sides of the container reservoir.

3. The method according to claim 1, wherein the container mixing movement includes various virtual points of the container centre line moving around respective virtual axes.

4. The method according to claim 1, wherein the container mixing movement involves moving the container iteratively from a first vertical position to a first intermediate position wherein the container is tilted in a first direction, to an opposite second vertical position, and back to the first vertical position via a second intermediate position wherein the container is tilted in a second direction which is opposite to the first tilting direction.

5. The method according to claim 1, wherein each mentioned virtual axis extends in a substantially horizontal direction, wherein the container reaches or maintains a substantially vertical container position during at least part of the mixing movement thereof.

6. The method according to claim 1, wherein the container is being supported by a container holder, wherein a drive mechanism is provided to move the container holder to provide the above-mentioned mixing movement of the container.

7. The method according to claim 1, wherein the product is a foodproduct, for example a foodproduct comprising cream.

8. An apparatus arranged to charge aerosol containers, the apparatus comprising:

at least one container holder to hold an aerosol container; and fluid supply means to gradually supply a fluid to a container held by the container holder, via product discharge means of the container;

characterised in that the apparatus is configured to apply a mixing movement to the container held by the holder during use, the mixing movement involving at least a first virtual point of a virtual centre line of the container reservoir following an endless path around a respective virtual axis.

9. The apparatus according to claim 8, configured to iteratively move the container holder in a manner to cause at least part of a product that is contained in a container, being held by that holder during use, to follow an endless loop along inner sides of the container reservoir.

10. The apparatus according to claim 8, comprising at least one drive mechanism to iteratively move each container holder, such that at least a first virtual point of a virtual centre line of the container reservoir of the container held by that holder moves around a respective virtual axis.

11. The apparatus according to claim 10, wherein each container holder is provided with its own dedicated drive mechanism.

12. The apparatus according to claim 10, wherein the drive mechanism comprises a driven shaft which is coupled eccentrically to part of the container holder, and to a counterbalance mass configured to counterbalance the mass of the container holder and a container held thereby.

13. The apparatus according to claim 8, wherein a first part of each container holder is provided with a first axis that is guided along a substantially circular or ellipse path.

14. The apparatus according to claim 13, wherein a second part of the container holder is provided with a second axis that is guided iteratively along one of: a curved path, a substantially straight path, a substantially circular path, and a substantially ellipse path, wherein the first axis and second axis are spaced-apart from each other.

15. The apparatus according to claim 8, wherein each container holder can be brought into a container loading/unloading position, in which loading/unloading position the holder cart hold an aerosol container in a substantially vertical container orientation.

16. A method according to claim 1, wherein the fluid is a propellant, wherein at least 15 w % of the propellant is $N_2$ gas and wherein the propellant further consists of $N_2O$ gas.

17. A method according to claim 1, wherein the fluid does not comprise $N_2$.

18. A method according to claim 1, wherein the fluid does not consist of: the combination of $N_2$ gas and $N_2O$ gas.

19. A method according to claim 1, wherein the fluid does not consist of: a propellant formed of the combination of at least 15 w % $N_2$ and a remaining $N_2O$.

20. A method according to claim 1, the fluid including one or more of: propane, butane and isobutane.

* * * * *

UNITED STATES PATENT AND TRADEMARK OFFICE

CERTIFICATE OF CORRECTION

PATENT NO. : 8,381,778 B2
APPLICATION NO. : 12/524380
DATED : February 26, 2013
INVENTOR(S) : Hubertus Maria Roland Van Melick It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 804 days.

Signed and Sealed this
First Day of September, 2015

Michelle K. Lee

Michelle K. Lee
*Director of the United States Patent and Trademark Office*